US009228150B2

(12) United States Patent
Aguilar et al.

(10) Patent No.: US 9,228,150 B2
(45) Date of Patent: Jan. 5, 2016

(54) ZINC DITHIOCARBAMATE LUBRICATING OIL ADDITIVES

(75) Inventors: Gaston A. Aguilar, Milford, CT (US); Francis S. Cheng, West Hartford, CT (US); Kevin J. Chase, Branford, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 314 days.

(21) Appl. No.: 13/437,303

(22) Filed: Apr. 2, 2012

(65) Prior Publication Data

US 2012/0258896 A1 Oct. 11, 2012

Related U.S. Application Data

(60) Provisional application No. 61/474,063, filed on Apr. 11, 2011.

(51) Int. Cl.
*C10M 135/18* (2006.01)

(52) U.S. Cl.
CPC ..... *C10M 135/18* (2013.01); *C10M 2219/068* (2013.01); *C10N 2210/02* (2013.01); *C10N 2230/06* (2013.01); *C10N 2230/10* (2013.01); *C10N 2230/36* (2013.01); *C10N 2240/102* (2013.01); *C10N 2240/104* (2013.01)

(58) Field of Classification Search
CPC ..... C10M 135/18; C10M 2219/068; C10N 2210/02; C10N 2230/06; C10N 2230/10; C10N 2230/36; C10N 2240/102; C10N 2240/104
USPC ..... 508/363
See application file for complete search history.

(56) References Cited

U.S. PATENT DOCUMENTS

| | | | | |
|---|---|---|---|---|
| 2,265,851 | A | 12/1941 | Matheson | |
| 4,479,883 | A | 10/1984 | Shaub et al. | |
| 4,612,129 | A | 9/1986 | DiBiase et al. | |
| 5,364,545 | A * | 11/1994 | Arai et al. | 508/365 |
| 5,696,063 | A | 12/1997 | Tokashiki et al. | |
| 5,916,851 | A | 6/1999 | Hosonuma et al. | |
| 6,121,211 | A | 9/2000 | Stachew et al. | |
| 6,723,685 | B2 | 4/2004 | Hartley et al. | |
| 2004/0171501 | A1 | 9/2004 | Leeuwen | |

FOREIGN PATENT DOCUMENTS

| | | | |
|---|---|---|---|
| EP | 07-70668 | A1 | 5/1997 |
| EP | 0803566 | A1 | 10/1997 |
| JP | 10-121078 | A1 | 5/1998 |
| JP | 11-092778 | A1 | 6/1999 |

* cited by examiner

*Primary Examiner* — Taiwo Oladapo
(74) *Attorney, Agent, or Firm* — Norris McLaughlin & Marcus P.A.

(57) ABSTRACT

A lubricating oil composition comprising a zinc dithiocarbamate fraction, for use in a gasoline or diesel engine equipped with fluoroelastomer seals, wherein said zinc dithiocarbamate fraction consists essentially of zinc dithiocarbamate molecules per Formula I:

having alkyl groups $R^1$, $R^2$, $R^3$, and $R^4$, wherein the weighted total average for carbon chain lengths for all molecules together is 9 or more:

(I)

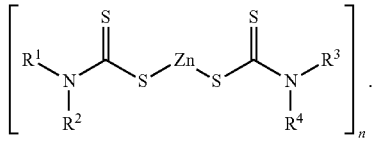

9 Claims, No Drawings

ZINC DITHIOCARBAMATE LUBRICATING OIL ADDITIVES

BACKGROUND OF THE INVENTION

Zinc dithiocarbamate-containing lubricant oil compositions are generally not used in modern gasoline and diesel engines containing fluoroelastomer seals despite their good antioxidant, sludge preventing, antiwear and extreme pressure properties due to their generally poor seal compatibility. Seal compatibility is of high importance in the lubricant industry, and the new GF-5 standard for lubricating oils established in October 2010 by the International Lubricants Standardization and Approval Committee (ILSAC) includes seal compatibility standards utilizing the ASTM D7216 test. The test involves immersion of a sample of the fluoroelastomer in the lubricating oil and heating at 150° C. for 336 hours. The aged fluoroelastomer sample is then tested for elongation at break, hardness, and retained tensile strength, and compared with the properties of a fresh fluoroelastomer sample.

Zinc dithiocarbamates are reaction products of a primary and/or secondary amine with carbon disulfide and a zinc source, a zinc salt to give compounds of the following structure (I):

(I)

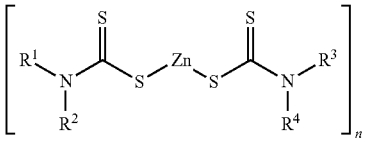

wherein $R^1$, $R^2$, $R^3$ and $R^4$ are independently hydrogen, alkyl or arylalkyl groups. Typically zinc dithiocarbamates exist as monomers or dimers, i.e. n is 1 or 2. Typically smaller alkyl groups where $R^1$, $R^2$, $R^3$ and $R^4$ have 3 to 8 carbon atoms apiece are enough to impart oil solubility in a lubricating composition.

Fluoroelastomers (also known as Viton® a registered trademark of Dupont) are elastomers containing fluorine. They were introduced in 1957 to meet the needs of the aerospace industry for a high-performance seal elastomer. Since then, the use of Viton has expanded to many other industries, especially in the automotive, fluid power, appliance, and chemical fields.

Standard types of Viton products are designated as A, B, or F according to their relative resistance to attack by fluids and chemicals. The differences in chemical resistance are the result of different levels of fluorine in the elastomer, which is determined by the types and relative amounts of copolymerized monomers that comprise the elastomer. Typically Viton A contains 66% fluorine, Viton B 68% fluorine, and Viton F 70% fluorine.

U.S. Pat. No. 6,723,685 teaches nitrogen-containing lubricant additives are suspected, over time contributing to the deterioration of Viton seals.

U.S. Pat. No. 6,121,211 teaches a lubricating oil composition containing a metal thiocarbamate as a sludge preventive, and a Viton seal protecting amount of at least one aldehyde or epoxide or a mixture thereof. The metal thiocarbamate can be a zinc dithiocarbamate, preferably where the alkyl chain lengths $R^1$ and $R^2$ ranges between 3 and 5 carbon atoms. It is necessary however to have a seal protecting amount of an aldehyde and/or epoxide in the formulation.

U.S. Pat. No. 5,364,545 teaches a lubricating oil composition of a lubricating oil basestock, an organomolybdenum compound, and one or a combination of organozinc compounds consisting of zinc dithiophosphate and/or zinc dithiocarbamate along with an organic amide. However, nothing is taught about seal compatibility of these compositions.

U.S. Pat. No. 4,479,883 teaches a lubricating oil composition having particularly improved friction reducing properties which comprises an ester of a polycarboxylic acid with a glycol or glycercol and a selected metal dithiocarbamate and contains a relatively low level of phosphorus. The metal dithiocarbamate can be a zinc dithiocarbamate. Nothing is taught about seal compatibility.

U.S. Pat. No. 4,612,129 teaches sulfur-containing, oil-soluble compositions which are useful as lubricating oil additives, particularly in lubricants containing little or no phosphorus. Some of the compositions of the invention include at least one zinc dithiocarbamate wherein the alkyl groups range from between 2 and 8 carbon atoms. These lubricating compositions exhibit good nitrile seal compatibility, but no mention of fluoroelastomer seal compatibility.

U.S. Pat. No. 2,265,851 teaches metal dithiocarbamates in a lubricating oil composition in which the alkyl groups $R^1$ and $R^2$ together contain 8 or less carbon atoms and the metal could be zinc.

Because of the ability of zinc dithiocarbamates to perform as good antioxidants, sludge preventers, antifriction additives, and extreme pressure additives in a lubricating oil composition, it would be highly desirable to improve their fluoroelastomer seal performance.

SUMMARY OF THE INVENTION

We have surprisingly found that even at high concentrations, zinc dithiocarbamates prepared from one or more dialkylamines such that in the resulting ZnDTC, each alkyl group $R^1$, $R^2$, $R^3$ and $R^4$ contains on average 9 or more, preferably 12 or more carbon atoms, have greatly improved fluoroelastomer seal compatibility in a fully-formulated motor oil composition over zinc dithiocarbamates or zinc dithiocarbamate blends containing less than 9 carbon atoms, on average, in each alkyl group. Alternatively, the inventive zinc dithiocarbamates may have 9 or more, preferably 12 or more carbon atoms, as an average among $R^1$-$R^4$. Still further, the inventive zinc dithiocarbamates may consist essentially of a blend of zinc dithiocarbamate molecules, wherein each molecule may have any number of average carbon chain length, so long as the weighted total average for all zinc dithiocarbamate molecules is 9 or more carbon atoms per R group. These formulations have been able to pass the GF-5 seal compatibility standard for fluoroelastomers. We have found this in the absence of adding a seal-stabilizing chemical such as an aldehyde and/or epoxide to the fully formulated motor oil, and accordingly, an embodiment of the invention is a lubricating composition which is free or substantially-free (i.e. less than 0.01 weight %) of an aldehyde and/or epoxide. The invention also resides in a combination of a lubricating composition according to the invention, in combination with an internal combustion engine wherein the lubricating composition is brought into contact with fluoroelastomer seals; as well as a method of lubricating an internal combustion engine comprising the use of the lubricating composition according to the invention in an engine wherein the lubricating composition is brought into contact with fluoroelastomer seals.

DETAILED DESCRIPTION OF THE INVENTION

We have found that the object of the invention, namely the use of zinc dithiocarbamates according to Formula I in a lubricating composition intended for a gasoline or diesel engine containing fluoroelastomer seals, can be achieved wherein the zinc dithiocarbamate fraction consists of, or consists essentially of zinc dithiocarbamate molecules that contain alkyl groups $R^1$, $R^2$, $R^3$, and $R^4$ wherein the weighted total average for carbon chain lengths for all molecules together is 9 or more, preferably 12 or more carbon atoms. In a preferred embodiment, each alkyl group within the zinc dithiocarbamate molecules contain on average 9 or more, preferably 12 or more carbon atoms. In an additional embodiment, each zinc dithiocarbamate molecule contains on average 9 or more, preferably 12 or more carbon atoms.

(I)

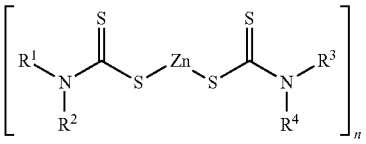

wherein $R^1$, $R^2$, $R^3$, and Ware independently hydrogen, alkyl or arylalkyl groups, and n=1 or 2.

Zinc Dithiocarbamate

Zinc dithiocarbamates are normally made by the reaction of a primary or secondary amine with carbon disulfide followed by the addition of a zinc salt to give the dithiocarbamate. Depending upon the amine's alkyl groups, the prepared zinc dithiocarbamate can either be monomeric, i.e. contain one zinc atom per molecule with two dithiocarbamate ligands, or dimeric, and contain two zinc atoms per molecule and four dithiocarbamate ligands.

(I)

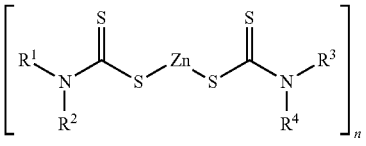

Typical alkyl groups $R^1$, $R^2$, $R^3$, and $R^4$ useful in this invention are those containing 9 or more carbon atoms on average and include alkyl, saturated and/or unsaturated, branched and/or linear, arylalkyl. The alkyl groups $R^1$, $R^2$, $R^3$, and $R^4$ can be the same or different, and each contain different numbers of carbon atoms, from 1 to 60. The alkyl groups can also contain ether linkages.

One of the preferable groups for $R^1$, $R^2$, $R^3$, and $R^4$ in the general formula (I) is an alkyl group having from 12 to 60 carbon atoms, more preferably having from 12 to 18 carbon atoms, such as lauryl, stearyl, tridecyl, isotridecyl and other groups. There is no limit on the isomeric nature of the alkyl groups. For example, isotridecyl can represent a variety of structural isomers, both branched and linear.

Another of the preferable groups for $R^1$, $R^2$, $R^3$, and $R^4$ in the general formula (I) is an alicyclic alkyl group. Still another preferable group for $R^1$, $R^2$, $R^3$, and $R^4$ is alkoxy, with one or more oxygens in the chain.

The alkyl groups $R^1$, $R^2$, $R^3$, and $R^4$ can be derived from natural fatty oils such as coconut oil, rapeseed oil, flaxseed oil, sunflower oil, tallow, and lard. Alkyl groups derived from the natural fatty oils usually have mixed chain lengths. For example alkyl groups derived from coconut oil have on average 12 carbon atoms (lauryl), but also contain myristyl ($C_{14}$), palmityl ($C_{16}$), caprylyl ($C_8$), capryl ($C_{10}$), stearyl ($C_{18}$), oleyl ($C_{18}$), linolyl ($C_{18}$), both saturated an unsaturated.

The alkyl groups can also be derived from industrial processes. The oligomerization of butylene and propylene to form mixtures of longer branched alkyl groups can be used as a feedstock to produce alkyl groups.

The zinc dithiocarbamate can also be a blend of two or more different zinc dithiocarbamates, so long as the total weighted average of alkyl chain lengths is 9 or more carbon atoms. For example, a blend of a diamyl zinc dithiocarbamate and ditridecyl zinc dithiocarbamate may be provided, as long as the ratio (or weighted average) of diamyl to ditridecyl is such to give an average alkyl chain lengths of 9 or greater.

The zinc dithiocarbamates can also be prepared from a mixture of secondary amines, such as ditridecylamine and diamylamine, so long as total weighted average of chain lengths is 9 or more carbon atoms.

In this respect, due to the adverse impact of low carbon (i.e. 8 or fewer) zinc dithiocarbamates, the inventive lubricating composition should have a zinc dithiocarbamate fraction which consists of, or consists essentially of zinc dithiocarbamates which, together, have a weighted average carbon chain length of 9 or greater. The zinc dithiocarbamate fraction may consist solely of molecules in which each group $R^1$-$R^4$ has 9 or more carbon atoms; and/or of molecules in which the average number of carbon atoms for $R^1$-$R^4$ in each molecule is 9 or more carbon atoms; and/or of molecules having any number of carbon atoms for $R^1$-$R^4$, so long as the total weighted average of carbon chain lengths for all zinc dithiocarbamate molecules is 9 or greater.

The amount of the zinc dithiocarbamate useful in this invention in a lubricating oil formulation can range from 1,000 ppm of Zn imparted to the lubricating oil from the zinc dithiocarbamate, to 20 ppm of Zn imparted to the lubricating oil from the zinc dithiocarbamate.

Base Oils

The base oils employed as lubricant vehicles are typical oils used in automotive and industrial applications such as, among others, turbine oils, hydraulic oils, gear oils, crankcase oils and diesel oils. Natural base oils include mineral oils, petroleum oils, paraffinic oils and the vegetable oils. The base oil may also be selected from oils derived from petroleum hydrocarbon and synthetic sources. The hydrocarbon base oil may be selected from naphthenic, aromatic, and paraffinic mineral oils. The synthetic oils may be selected from, among others, ester-type oils (such as silicate esters, pentaerythritol esters and carboxylic acid esters), hydrogenated mineral oils, silicones, silanes, polysiloxanes, alkylene polymers, and polyglycol ethers.

The lubricating composition may contain the necessary ingredients including the following:

1. Borated and/or non-borated dispersants
2. Additional antioxidant compounds
3. Friction modifiers
4. Pressure/anti-wear additives
5. Viscosity modifiers
6. Pour point depressants
7. Detergents
8. Antifoaming agents 1. Borated and/or Non-Borated Dispersants Non-borated ashless dispersants may be incorporated within the final fluid composition in an amount comprising up to 10 weight percent on an oil-free basis. Many types of ashless dispersants listed below are known in the art. Borated ashless dispersants may also be included.

(A) "Carboxylic dispersants" are reaction products of carboxylic acylating agents (acids, anhydrides, esters, etc.) containing at least about 34 and preferably at least about 54 carbon atoms reacted with nitrogen-containing compounds (such as amines), organic hydroxy compounds (such aliphatic compounds including monohydric and polyhydric alcohols, or aromatic compounds including phenols and naphthols), and/or basic inorganic materials. These reaction products include imide, amide and ester reaction products of carboxylic acylating agents. Examples of these materials include succinimide dispersants and carboxylic ester dispersants. The carboxylic acylating agents include alkyl succinic acids and anhydrides wherein the alkyl group is a polybutyl moiety, fatty acids, isoaliphatic acids (e.g., 8-methyloctadecanoic acid), dimer acids, addition dicarboxylic acids, addition (4+2 and 2+2) products of an unsaturated fatty acid with an unsaturated carboxylic reagent), trimer acids, addition tricarboxylic acids (e.g., Empol® 1040, Hystrene® 5460 and Unidyme® 60), and hydrocarbyl substituted carboxylic acylating agents (from olefins and/or polyalkenes). In one preferred embodiment, the carboxylic acylating agent is a fatty acid. Fatty acids generally contain from about 8 up to about 30, or from about 12 up to about 24 carbon atoms. Carboxylic acylating agents are taught in U.S. Pat. Nos. 2,444,328, 3,219,666 and 4,234,435, which are incorporated herein by reference. The amine may be a mono- or polyamine. The monoamines generally have at least one hydrocarbyl group containing 1 to about 24 carbon atoms, with from 1 to about 12 carbon atoms. Examples of monoamines include fatty ($C_8$-$C_{30}$) amines, primary ether amines, tertiary-aliphatic primary amines, hydroxyamines (primary, secondary or tertiary alkanol amines), ether N-(hydroxyhydrocarbyl)amines, and hydroxyhydrocarbyl amines. The polyamines include alkoxylated diamines, fatty diamines, alkylenepolyamines (ethylenepolyamines), hydroxy-containing polyamines, polyoxyalkylene polyamines, condensed polyamines (a condensation reaction between at least one hydroxy compound with at least one polyamine reactant containing at least one primary or secondary amino group), and heterocyclic polyamines. Useful amines include those disclosed in U.S. Pat. No. 4,234,435 and U.S. Pat. No. 5,230,714 that are incorporated herein by reference. Examples of these "carboxylic dispersants" are described in British Patent 1,306,529 and in U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433, which are incorporated herein by reference for disclosure of dispersants.

(B) "Amine dispersants" are reaction products of relatively high molecular weight aliphatic or alicyclic halides and amines, preferably polyalkylene polyamines. Examples thereof are described, for example, in U.S. Pat. Nos. 3,275,554, 3,438,757, 3,454,555, and 3,565,804, which are incorporated herein by reference for disclosure of dispersants.

(C) "Mannich dispersants" are the reaction products of alkyl phenols in which the alkyl group contains at least about 30 carbon atoms with aldehydes (especially formaldehyde) and amines (especially polyalkylene polyamines). The materials described in U.S. Pat. Nos. 3,036,003, 3,236,770, 3,414,347, 3,448,047, 346,172, 3,539,633, 3,586,629, 3,591,598, 3,634,515, 3,725,480, and 3,726,882 are incorporated herein by reference for disclosure of dispersants.

(D) Post-treated dispersants are obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds, molybdenum compounds, tungsten compounds or the like. U.S. Pat. Nos. 3,200,107, 3,282,955, 3,367,943, 3,513,093, 3,639,242, 3,649,659, 3,442,808, 3,455,832, 3,579,450, 3,600,372, 3,702,757, 3,708,422, 4,259,194, 4,259,195, 4,263,152, 4,265,773, 7,858,565 and 7,879,777 are incorporated herein by reference for disclosure of dispersants.

(E) Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymer dispersants are disclosed in U.S. Pat. Nos. 3,329,658, 3,449,250, 3,519,656, 3,666,730, 3,687,849, and 3,702,300, which are incorporated herein by reference for disclosure of dispersants and ashless dispersants.

Borated dispersants are described in U.S. Pat. Nos. 3,087,936 and 3,254,025, which are incorporated herein by reference for disclosure of borated dispersants.

Also included, as possible dispersant additives are those disclosed in U.S. Pat. Nos. 5,198,133 and 4,857,214, which are incorporated herein by reference. The dispersants of these patents compare the reaction products of an alkenyl succinimide or succinimide ashless dispersant with a phosphorus ester or with an inorganic phosphorus-containing acid or anhydride and a boron compound.

2. Additional Antioxidant Compounds

Other antioxidant may be used in the compositions of the present invention, if desired. Typical antioxidants include hindered phenolic antioxidants, secondary aromatic amine antioxidants, hindered amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tert-butylphenol, 4-methyl-2,6-di-tert-butylphenol, 2,4,6-tri-tert-butylphenol, 2-tert-butylphenol, 2,6-disopropylphenol, 2-methyl-6-tert-butylphenol, 2,4-dimethyl-6-tert-butylphenol, 4-(N,N-dimethylaminomethyl)-2,8-di-tert-butylphenol, 4-ethyl-2,6-di-tert-butylphenol, 2-methyl-6-styrylphenol, 2,6-distyryl-4-nonylphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically hindered un-bridged phenolic compounds. Illustrative methylene-bridged compounds include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylenebis(2,6-di-tert-butylphenol) and similar compounds. Particularly preferred are mixtures of methylene-bridged alkylphenols such as are described in U.S. Pat. No. 3,211,652, which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-.beta.-naphthylamine, phenyl-p-naphthylamine, alkyl- or aralkyl-substituted phenyl-.beta.-naphthylamine containing one or two alkyl or aralkyl groups each having up to about 16 carbon atoms, alkyl- or aralkyl-substituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

$$R^5—C_6H_4—NH—C_6H_4—R^6$$

where $R^5$ is an alkyl group (preferably a branched alkyl group) having 8 to 12 carbon atoms, (more preferably 8 or 9 carbon atoms) and $R^6$ is a hydrogen atom or an alkyl group (preferably a branched alkyl group) having 8 to 12 carbon atoms, (more preferably 8 or 9 carbon atoms). Most preferably, $R^5$ and $R^6$ are the same. One such preferred compound is available commercially as Naugalube® 438L, a material which is understood to be predominately a 4,4'-dinonyldiphenylamine (i.e., bis(4-nonylphenyl)(amine)) in which the nonyl groups are branched.

The hindered amines are another type aminic antioxidants that may be used in compositions of this invention with two predominating types, the pyrimidines and piperidines. These are all described in great detail above, and in U.S. Pat. No. 5,073,278, U.S. Pat. No. 5,273,669, and U.S. Pat. No. 5,268,113. Preferred hindered amines include 4-stearoyloxy-2,2,6,6-tetramethylpiperidine and dodecyl-N-(2,2,6,6,-tetramethyl-4-piperidinyl)succinate, sold under the trade names Cyasorb® UV-3853 and Cyasorb® UV-3581 from Cytec, di(2,2,6,6-tetramethylpiperidin-4-yl) sebacate and di(1,2,2,6,6-pentamethylpiperidin-4-yl) sebacate, sold as Songlight® 7700 and Songlight® 2920LQ from Songwon, and bis(1-octyloxy-2,2,6,-tetramethyl-4-piperidyl) sebacate, sold as Tinuvin® 123 by Ciba.

Another useful type of antioxidant for preferred inclusion in the compositions of the invention are one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Sulfur containing materials such as the methylene bis(dialkyldithiocarbamates) wherein the alkyl group contains 4 to 8 carbon atoms are useful antioxidants. For example, methylenebis(dibutyldithiocarbamate) is commercially available as VANLUBE 7723® from R. T. Vanderbilt Co., Inc).

Mixtures of different antioxidants may also be used. One suitable mixture is comprised of a combination of: (i) an oil-soluble mixture of at least three different sterically hindered tertiary butylated monohydric phenols, which is in the liquid state at 25° C.; (ii) an oil-soluble mixture of at least three different sterically-hindered, tertiary butylated methylene-bridged polyphenols; and (iii) at least one bis(4-alkylphenyl)amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii), as disclosed in U.S. Pat. No. 5,328,619, which is incorporated herein by reference.

Other useful preferred antioxidants are those included in the disclosure of U.S. Pat. No. 4,031,023, which is herein incorporated by reference.

3. Seal Swell Compositions

Compositions that are designed to keep seals pliable are also well known in the art. A preferred seal swell composition is isodecyl sulfolane. The seal swell agent is preferably incorporated into the composition at about 0.1-3 weight percent. Substituted 3-alkoxysulfolanes are disclosed in U.S. Pat. No. 4,029,587, which is incorporated herein by reference.

4. Friction Modifiers

Friction modifiers are also well known to those skilled in the art. A useful list of friction modifiers is included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

The preferred friction modifier is a borated fatty epoxide as previously mentioned as being included for its boron content. Friction modifiers are preferably included in the compositions in the amounts of 0.1-10 weight percent and may be a single friction modifier or mixtures of two or more.

Friction modifiers also include metal salts of fatty acids. Preferred cations are zinc, magnesium, calcium, and sodium and any other alkali or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

5. Extreme Pressure/Antiwear Agents

Dialkyl dithiophosphate succinates may be added to provide antiwear protection. Zinc salts are preferably added as zinc salts of dihydrocarbyl phosphorodithioic acids and may be represented by the following formula:

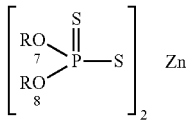

wherein $R_7$ and $R_8$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly, preferred $R_7$ and $R_8$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater.

Also included in lubricating compositions in the same weight percent range as the zinc salts to give antiwear/extreme pressure performance are dibutyl hydrogen phosphite (DBPH) and triphenyl monothiophosphate, and the thiocarbamate ester formed by reacting dibutyl amine, carbon disulfide and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Antimony or lead salts may also be used for extreme pressure. The preferred salts are of dithiocarbamic acid such as antimony diamyldithiocarbamate.

6. Viscosity Modifiers

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Summaries of viscosity modifiers can be found in U.S. Pat. Nos. 5,157,088, 5,256,752 and 5,395,539, which are incorporated herein by reference. The VMs and/or DVMs preferably are incorporated into the fully formulated compositions at a level of up to 10% by weight.

7. Pour Point Depressants (PPD)

These components are particularly useful to improve low temperature qualities of lubricating oils. A preferred pour point depressant is an alkylnaphthalene. Pour point depressants are disclosed in U.S. Pat. Nos. 4,880,553 and 4,753,745, which are incorporated herein by reference. PPDs are commonly applied to lubricating compositions to reduce viscosity measured at low temperatures and low rates of shear. The pour point depressants are preferably used in the range of 0.1-5 weight percent. Examples of tests used to access low temperature, low shear rate rheology of lubricating fluids include ASTM D97 (pour point), ASTM D2983 (Brookfield viscosity), D4684 (Mini-rotary Viscometer) and D5133 (Scanning Brookfield).

8. Detergents

Lubricating compositions in many cases also preferably include detergents. Detergents as used herein are preferably metal salts of organic acids. The organic acid portion of the detergent is preferably a sulphonate, carboxylate, phenate, or salicylate. The metal portion of the detergent is preferably an alkali or alkaline earth metal. Preferred metals are sodium, calcium, potassium and magnesium. Preferably, the detergents are overbased, meaning that there is a stoichiometric excess of metal over that needed to form the neutral metal salt.

Preferred overbased organic salts are the sulfonate salts having a substantially oleophilic character and which are formed from organic materials. Organic sulfonates are well known materials in the lubricant and detergent arts. The sulfonate compound should preferably contain on average from about 10 to about 40 carbon atoms, more preferably from about 12 to about 36 carbon atoms and most preferably from about 14 to about 32 carton atoms on average. Similarly, the phenates, oxylates and carboxylates preferably have a substantially oleophilic character.

While the present invention allows for the carbon atoms to be either aromatic or in paraffinic configuration, it is highly preferred that alkylated aromatics be employed. While naphthalene based materials may be employed, the aromatic of choice is the benzene moiety.

The one particularly preferred component is thus an overbased monosulfonated alkylated benzene, and is preferably the monoalkylated benzene. Preferably, alkyl benzene fractions are obtained from still bottom sources and are mono- or di-alkylated compounds. It is believed, in the present invention, that the mono-alkylated aromatics are superior to the dialkylated aromatics in overall properties.

It is preferred that a mixture of mono-alkylated aromatics (benzene) be utilized to obtain the mono-alkylated salt (benzene sulfonate) in the present invention. The mixtures wherein a substantial portion of the composition contains polymers of propylene as the source of the alkyl groups assist in the solubility of the salt. The use of monofunctional (e.g., mono-sulfonated) materials avoids crosslinking of the molecules with less precipitation of the salt from the lubricant. It is preferred that the salt be overbased. The excess metal from overbasing has the effect of neutralizing acids, which may build up in the lubricant. A second advantage is that the overbased salt increases the dynamic coefficient of friction. Preferably, the excess metal will be present over that which is required to neutralize the acids at about in the ratio of up to about 30:1, preferably 5:1 to 18:1 on an equivalent basis.

The amount of the overbased salt utilized in the composition is preferably from about 0.1 to about 10 weight percents on an oil free basis. The overbased salt is usually made up in about 50% oil with a TBN range of 10-600 on an oil free basis. Borated and non-borated overbased detergents are described in U.S. Pat. Nos. 5,403,501 and 4,792,410, which are herein incorporated by reference for disclosure pertinent hereto.

9. Phosphates

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof.

In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

One class of compounds are adducts of O,O-dialkyl-phosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl)phosphorodithioate.

The dithiophosphoric acid esters of carboxylic acid esters are another class of compounds useful to the invention. Preferred are alkyl esters having 2 to 8 carbon atoms, as for example 3-[[bis(1-methylethoxy)phosphinothioyl]thio]propionic acid ethyl ester.

A third class of ashless dithiophosphates for use with the present invention includes:

(i) those of the formula

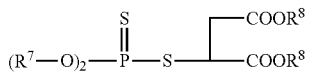

wherein $R^7$ and $R^8$ are independently selected from alkyl groups having 3 to 8 carbon atoms (commercially available as VANLUBE 7611M, from R. T. Vanderbilt Co., Inc.);

(ii) dithiophosphoric acid esters of carboxylic acid such as those commercially available as IRGALUBE® 63 from Ciba Geigy Corp.;

(iii) triphenylphosphorothionates such as those commercially available as IRGALUBE® TPPT from Ciba Geigy Corp.; and Zinc salts are preferably added to lubricating compositions in amounts of 0.1-5 triphenylphosphorothionates wherein the phenyl group may be substituted by up to two alkyl groups. An example of this group, among others, is triphenyl-phosphorothionate available commercially as IRGALUBE® TPPT (manufactured by Ciba-Geigy Corp.).

A preferred group of phosphorus compounds are dialkyphosphoric acid mono alkyl primary amine salts, such as those described in U.S. Pat. No. 5,354,484, which is herein incorporated by reference. Eighty-five percent phosphoric acid is the preferred compound for addition to the fully formulated ATF package and is preferably included at a level of about 0.01-0.3 weight percent based on the weight of the ATF.

The amine salts of alkyl phosphates are prepared by known methods, e.g., a method disclosed in U.S. Pat. No. 4,130,494, incorporated herein by reference. A suitable mono- or diester of phosphoric acid or their mixtures is neutralized with an amine. When monoester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or diesters. The amines can be selected from primary or secondary amines. Particularly preferred are tert-alkyl amines having 10 to 24 carbon atoms. These amines are commercially available as, for example, Primene® 81R manufactured by Rohm and Haas Co.

The sulfonic acid salts are well known in the art and are available commercially. Representative of the aromatic sulfonic acids that can be used in preparing the synergists of the invention are alkylated benzenesulfonic acids and alkylated naphthalenesulfonic acids having 1 to 4 alkyl groups of 8 to 20 carbons each. Particularly preferred are naphthalenesulfonates substituted by alkyl groups having 9 to 18 carbons each, as for example dinonylnaphthalenesulfonate.

10. Antifoamants

Antifoaming agents are well known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylate antifoamer available from Monsanto Polymer Products Co. of Nitro, W. Va. known as PC-1244. Also, a siloxane polyether copolymer antifoamer available from OSI Specialties, Inc. of Farmington Hills, Mich. may also be included. One such material is sold as SILWET-L-7220. The antifoam products are preferably included in the compositions of this invention at a level of 5 to 80 parts per million with the active ingredient being on an oil-free basis.

11. Rust Inhibitors

Embodiments of rust inhibitors include metal salts of alkylnapthalenesulfonic acids.

12. Copper Corrosion Inhibitors

Embodiments of copper corrosion inhibitors that may optionally be added include thiazoles, triazoles and thiadiazoles. Example embodiments of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles.

EXAMPLES

The following examples are given for the purpose of illustrating the invention and are not intended to limit the invention.

Example 1

Preparation of Zinc Di-Octadecyldithiocarbamate (FC-577-241)

To a 250 mL round bottomed flask was placed 60 g of dioctadecylamine (a fatty amine derived from a natural oil) and 2.40 g of zinc oxide. Carbon disulfide, 9.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon standing at ambient temperature a waxy solid with a Zn content of 4.2%.

Example 2

Preparation of Zinc Ditridecyldithiocarbamate (Propylene Based) (FC-577-242)

To a 250 mL round bottomed flask was placed 76.5 g of ditridecylamine and 8.10 g of zinc oxide. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give a pale yellow liquid with a Zn content of 6.0%.

Example 3

Preparation of Zinc Ditridecyldithiocarbamate (Butylene Based) (FC-577-243)

To a 250 mL round bottomed flask was placed 76.5 g of ditridecylamine and 8.10 g of zinc oxide. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give a pale yellow liquid with a Zn content of 5.8%.

Example 4

Preparation of Zinc Dicocodithiocarbamate (FC-577-219)

To a 250 mL round bottomed flask was placed 76.0 g of Armeen 2C, a commercially available dicocoamine, (predominantly $C_{12}$ alkyl groups derived from coconut oil), and 8.20 g of zinc oxide in 15.0 g of water. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove the water and the temperature was increased to 130° C., and the reaction was maintained in this state for 3 hours. The pale yellow material was then filtered through Celite at 120° C., which upon standing at ambient temperature gave a pale yellow liquid with a Zn content of 6.2%.

Comparative Example 5C

Preparation of Zinc Di-n-Octyldithiocarbamate (FC-577-240)

To a 250 mL round bottomed flask was placed 48.40 g of di-n-octylamine and 8.10 g of zinc oxide. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 8.1%.

Comparative Example 6C

Preparation of Zinc Di-2-Ethylhexyldithiocarbamate (FC-577-239)

To a 250 mL round bottomed flask was placed 48.30 g of di-2-ethylhexylamine and 8.10 g of zinc oxide. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 8.1%.

Example 7

A lubricant composition is prepared by incorporating the product from Example 1 to impart 620 ppm of additional zinc to a commercial SAE 5W-20 motor oil.

Example 8

A lubricant composition is prepared by incorporating the product from Example 1 to impart 310 ppm of additional zinc to a commercial SAE 5W-20 motor oil.

Example 9

A lubricant composition is prepared by incorporating the product from Example 2 to impart 620 ppm of additional zinc to a commercial SAE 5W-20 motor oil.

Example 10

A lubricant composition is prepared by incorporating the product from Example 2 to impart 310 ppm of additional zinc to a commercial SAE 5W-20 motor oil.

Example 11

A lubricant composition is prepared by incorporating the product from Example 3 to impart 620 ppm of additional zinc to a commercial SAE 5W-20 motor oil.

Example 12

A lubricant composition is prepared by incorporating the product from Example 3 to impart 310 ppm of additional zinc to a commercial SAE 5W-20 motor oil.

Example 13

A lubricant composition is prepared by incorporating the product from Example 4 to impart 620 ppm of additional zinc to a commercial SAE 5W-20 motor oil.

Example 14

A lubricant composition is prepared by incorporating the product from Example 4 to impart 310 ppm of additional zinc to a commercial SAE 5W-20 motor oil.

Comparative Example 15

A lubricant composition is prepared by incorporating the product from Example 5C to impart 620 ppm of additional zinc to a commercial SAE 5W-20 motor oil.

Comparative Example 16

A lubricant composition is prepared by incorporating the product from Example 5C to impart 310 ppm of additional zinc to a commercial SAE 5W-20 motor oil.

Comparative Example 17

A lubricant composition is prepared by incorporating the product from Example 6C to impart 620 ppm of additional zinc to a commercial SAE 5W-20 motor oil.

Comparative Example 18

A lubricant composition is prepared by incorporating the product from Example 6C to impart 310 ppm of additional zinc to a commercial SAE 5W-20 motor oil.

Comparative Example 19

This is the commercial SAE 5W-20 motor oil utilized in the Examples 7-14 and Comparative Examples 15-18.

Example 20

Viton Seal Compatibility Testing

Viton seal testing was performed according to ASTM D7216 utilizing a Viton FKM fluoroelastomer. Viton coupons were immersed in the motor oil samples made in Examples 7-14 and Comparative Examples 15-19, then heated at 150° C. for 336 hours. The aged coupons were then tested for hardness, retained elongation, and retained tensile strength. The GF-5 limits are for hardness; + or −6 Durometer A hardness points; retained elongation, 40-110%; retained tensile strength, 35-110%. The performance results are in Table 1.

TABLE 1

Viton Seal Compatibility Testing

| | Average Alkyl Group Carbon Atom Number | Added Zinc Content, ppm | Change in Hardness, points | Change in Tensile Strength, % | Change in Retained Elongation, % | Pass/Fail |
|---|---|---|---|---|---|---|
| Example 7 | 18 | 620 | −0.7 | 81.2 | 73.8 | Pass |
| Example 8 | 18 | 310 | −0.6 | 85.6 | 80.2 | Pass |
| Example 9 | 13 | 620 | −0.3 | 53.8 | 51.8 | Pass |
| Example 10 | 13 | 310 | −0.6 | 70.1 | 60.9 | Pass |
| Example 11 | 13 | 620 | −0.5 | 48.2 | 49.3 | Pass |
| Example 12 | 13 | 310 | −0.7 | 63.5 | 59.0 | Pass |
| Example 13 | 12 | 620 | −3.6 | 46.2 | 45.4 | Pass |
| Example 14 | 12 | 310 | −2.0 | 68.7 | 63.9 | Pass |
| Comparative Example 15 | 8 | 620 | 2.9 | 25.6 | 25.6 | Fail |
| Comparative Example 16 | 8 | 310 | 0.8 | 35.8 | 36.5 | Fail |
| Comparative Example 17 | 8 | 620 | 1.7 | 30.2 | 25.9 | Fail |
| Comparative Example 18 | 8 | 310 | 0.8 | 41.8 | 33.6 | Fail |
| Comparative Example 19 | N/A | 0 | −1.1 | 98.3 | 94.5 | Pass |

It is clear from the results that the zinc dithiocarbamate compounds that have alkyl chain lengths $R^1$-$R^4$ equal to or greater than 9, and particularly, great than or equal to 12 carbon atoms on average pass three aspects of the seal compatibility test, even at a relatively high molar concentration of 620 ppm of added zinc to the lubricating oil. The Comparative Examples 15-18 with $R^1$ through $R^4$ each equal to 8 carbon atoms fail most aspects of the testing, and pass only the change in hardness.

Example 21

Preparation of Mixed Amines Zinc Dithiocarbamate with an Average Carbon Chain Length of 9. (FC-602-51)

To a 250 mL round bottomed flask was placed 38.90 g of ditridecylamine, 15.70 g of diamylamine, and 8.14 g of zinc oxide. Carbon disulfide, 16.0 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 7.5%.

Example 22

Preparation of Mixed Amines Zinc Dithiocarbamate with an Average Carbon Chain Length of 12.2. (FC-602-52)

To a 250 mL round bottomed flask was placed 70.00 g of ditridecylamine, 3.14 g of diamylamine, and 8.14 g of zinc oxide. Carbon disulfide, 15.2 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 6.0%.

Example 23

Preparation of Mixed Amines Zinc Dithiocarbamate with an Average Carbon Chain Length of 11.4. (FC-602-53)

To a 250 mL round bottomed flask was placed 62.24 g of ditridecylamine, 6.28 g of diamylamine, and 8.14 g of zinc oxide. Carbon disulfide, 15.20 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 6.6%.

Example 24

Preparation of Mixed Amines Zinc Dithiocarbamate with an Average Carbon Chain Length of 10.6. (FC-602-54)

To a 250 mL round bottomed flask was placed 54.46 g of ditridecylamine, 9.42 g of diamylamine, and 8.14 g of zinc oxide. Carbon disulfide, 15.20 g, was then added dropwise, and the mixture was stirred for 30 minutes. The flask was then stirred and heated for 2 hours at 70° C., and then stirred for an addition 2 hours at 90° C. A vacuum was then applied to remove water of reaction and the temperature was increased to 130° C., and the reaction was maintained in this state for 3 hours. The pale yellow material was then filtered through Celite at 120° C., to give, upon a pale yellow liquid with a Zn content of 6.7%.

Example 25

A lubricant composition is prepared by incorporating the product from Example 20 to impart 620 ppm of additional zinc to a commercial SAE 5W-20 motor oil.

Example 26

A lubricant composition is prepared by incorporating the product from Example 21 to impart 620 ppm of additional zinc to a commercial SAE 5W-20 motor oil.

Example 27

A lubricant composition is prepared by incorporating the product from Example 22 to impart 620 ppm of additional zinc to a commercial SAE 5W-20 motor oil.

Example 28

A lubricant composition is prepared by incorporating the product from Example 23 to impart 620 ppm of additional zinc to a commercial SAE 5W-20 motor oil.

Comparative Example 29

A lubricant composition is prepared by incorporating pure diamyl zinc dithiocarbamate to impart 620 ppm of additional zinc to a commercial SAE 5W-20 motor oil.

Example 30

Viton Seal Compatibility Testing

Testing was performed as described in Example 20.

TABLE 2

Viton Seal Compatibility Testing

| | Average Alkyl Group Carbon Atom Number | Added Zinc Content, ppm | Change in Hardness, points | Change in Tensile Strength, % | Change in Retained Elongation, % | Pass/ Fail |
|---|---|---|---|---|---|---|
| Example 25 | 9 | 620 | 0.1 | 72.8 | 67.1 | Pass |
| Example 26 | 12.2 | 620 | −0.2 | 77.2 | 72.9 | Pass |
| Example 27 | 11.4 | 620 | −0.7 | 79.4 | 71.1 | Pass |
| Example 28 | 10.6 | 620 | −0.2 | 65.6 | 59.1 | Pass |
| Comparative Example 29 | 5 | 620 | 2.8 | 37.4 | 32.0 | Fail |
| Comparative Example 19 | N/A | 0 | −1.1 | 98.3 | 94.5 | Pass |

It is clear from the results that the zinc dithiocarbamate compounds made from blends that have average alkyl chain lengths $R^1$-$R^4$ equal to or greater than 9, and particularly, great than or equal to carbon atoms on average pass three aspects of the seal compatibility test, even at a relatively high molar concentration of 620 ppm of added zinc to the lubricating oil. The Comparative Example 28 failed one aspect of the testing, the change in retained elongation, and was very close in the change in tensile strength.

We claim:

1. A method for lubricating a gasoline or diesel engine containing fluoroelastomer seals to provide antioxidant, anti-wear and extreme pressure protection to the engine while providing improved seal compatibility, comprising the step of: using a lubricating oil composition in the engine and in contact with the seals, wherein the lubricating oil composition comprises a zinc dithiocarbamate fraction, wherein said zinc dithiocarbamate fraction consists essentially of zinc dithiocarbamate molecules per Formula I where n=1 or 2, having alkyl groups $R^1$, $R^2$, $R^3$, and $R^4$, such that each of said alkyl groups has 12 to 18 carbon atoms:

(I)

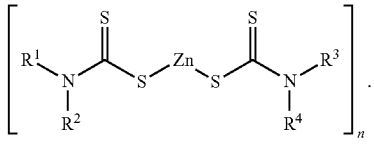

and wherein the amount of zinc attributed to the zinc dithiocarbamate is between about 310 and 620 ppm; and whereby a fluoroelastomer seal compatibility is achieved according to ASTM D7216.

2. The method according to claim 1, wherein the composition is substantially free of aldehyde and/or epoxy.

3. A gasoline or diesel engine comprising fluoroelastomer seals, and a lubricating oil composition in contact with the seals, the lubricating oil composition comprising a zinc dithiocarbamate fraction, wherein said zinc dithiocarbamate fraction consists essentially of zinc dithiocarbamate molecules per Formula I where n=1 or 2, having alkyl groups $R^1$, $R^2$, $R^3$, and $R^4$, such that each of said alkyl groups has 12 to 18 carbon atoms:

(I)

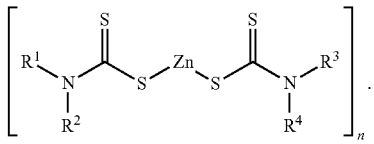

and wherein the amount of zinc attributed to the zinc dithiocarbamate is between about 310 and 620 ppm; and whereby a fluoroelastomer seal compatibility is achieved according to ASTM D7216.

4. The method of claim 1, wherein each of the alkyl groups has 18 carbon atoms.

5. The engine of claim 3, wherein each of the alkyl groups has 18 carbon atoms.

6. The method of claim 1, wherein the amount of zinc is about 620 ppm.

7. The method of claim 4, wherein the amount of zinc is about 620 ppm.

8. The engine of claim 3, wherein the amount of zinc is about 620 ppm.

9. The engine of claim 5, wherein the amount of zinc is about 620 ppm.

* * * * *